US006121889A

United States Patent [19]

Janda et al.

[11] Patent Number: 6,121,889

[45] Date of Patent: Sep. 19, 2000

[54] IN-WALL ELECTRONIC TIMER

[75] Inventors: Rudolph W. Janda; Kenneth W. Michaels, both of Spring Grove, Ill.

[73] Assignee: Intermatic Incorporated, Spring Grove, Ill.

[21] Appl. No.: 08/840,609

[22] Filed: Apr. 24, 1997

[51] Int. Cl.[7] ..... G08B 5/36; G08B 1/00

[52] U.S. Cl. ..... 340/815.47; 340/309.15; 340/815.48; 340/815.49; 340/815.73; 340/525; 340/656; 361/195; 361/616; 361/679; 307/141; 200/27 B; 200/38 B; 200/293

[58] Field of Search ..... 340/815.47–815.49, 340/815.73, 525, 309.15, 656; 361/627, 622, 616, 644, 679, 195; 307/38, 132 E, 116, 141; 200/38 B, 293, 27 B

[56] References Cited

U.S. PATENT DOCUMENTS 5,160,853 11/1992 Simon et al. ..... 307/140

5,309,032 5/1994 Nilssen ..... 307/140

5,802,171 9/1998 Deutsch ..... 379/419

*Primary Examiner*—Donnie L. Crosland

*Attorney, Agent, or Firm*—Brinks Hofer Gilson & Lione

[57] ABSTRACT

An in-wall mounted electric timer comprising a housing for mounting in an electric box in a wall. The electric timer comprises a user interface on the housing. The user-interface comprises an input panel and a display. The electric timer further includes a movable cover panel covering the user interface. The cover panel has a rearward extending post aligned with the input panel to operate the input panel by moving action of the cover panel, wherein at least a portion of the cover panel is transparent enabling observation of the display through the cover panel.

24 Claims, 5 Drawing Sheets

10
20
28
30
34
65
66
64
36
50
58
52
38
26
28
68
70
30
44
62

IN-WALL ELECTRONIC TIMER

BACKGROUND OF THE INVENTION

The present invention relates to an improved in-wall mounted electronic timer.

Electric timers are used in households, businesses, and institutions to automatically operate electric appliances, lighting, and so on. One type of electric timer is used as a substitute for a conventional electric wall switch. This type of electric timer replaces a conventional wall switch with a timer that has an ability to automatically operate whatever had been previously operated by the wall switch. Thus, if the conventional wall switch had been used to operate an electric receptacle, the electric timer can be programmed to automatically turn on and off whatever is plugged into the receptacle. Likewise, if the conventional wall switch had been used to turn on a lighting fixture, the electric timer can be programmed to automatically turn on and off the lighting fixture.

As electronics become more miniaturized, it is possible to provide more features and greater functionality into electric timers, including multiple ON/OFF times, varying ON/OFF times, etc. However, including such features in an electric timer can complicate programming and operation of the timer by the user. As an electric timer is provided with more features and greater functionality, it becomes desirable to provide a user interface on the electric timer that makes the programming and operation of the electric timer easy-to-use and user-friendly.

One way that can be used to provide a user-friendly interface on an electric timer is to use a push button input panel and a display screen (e.g. an LCD, LED, and so on). The display screen could be used to facilitate use of the input panel push buttons. Although it is possible to provide relatively sophisticated features in an electric timer, a problem to be overcome is how to include an easy-to-use user interface for the various timer functions within the size constraints imposed by the conventional electric switch format. As mentioned above, one type of electric timer is intended to replace a conventional electric switch. A conventional electric switch conforms to a standardized overall size format of approximately 3 inches by approximately 2 inches. Therefore, in order to be used as a replacement for a conventional electric switch, the electric timer should conform generally to the size format of a conventional electric switch.

Push button panels and displays are available in dimensions that can be accommodated in the size format dictated by the dimensions of a conventional switch. However, if push button panels and displays are incorporated into a user interface of an electric timer having these dimensions, the sizes of the buttons and display panel are made small, and thus may be hard to use and less user-friendly.

In some situations, it may be desired to override the electric timer and manually operate the switch. Many electric timers provide a means of overriding the programming functions and operating the electric switch manually. In situations in which it may be desired to operate the switch manually, it is very possible that the place in which the switch is located may be dark, and accordingly it may be difficult to see the timer input panel and display especially if the timer input panel and push buttons are small. In such situations, it may be difficult to operate the switch manually because the timer panel and display, which are well-suited to programming and operating the sophisticated features and functions of the timer, are not well-suited to manually operating the switch in the dark.

Accordingly, an object of the present invention is to provide an improved electric timer and interface therefore. It is a further object to provide an electric timer that provides an user-friendly interface for programming and operation as well as provides a way to easily override the programming to operate the switch manually.

SUMMARY OF THE INVENTION

To address the above concerns, the present invention provides an in-wall mounted electric timer comprising a housing for mounting in an electric box in a wall. The electric timer includes a user interface on the housing. The user-interface comprises an input panel and a display. The electric timer further includes a movable cover panel covering the user interface. The cover panel has a rearward extending post aligned with the input panel to operate the input panel by moving action of the cover panel, wherein at least a portion of the cover panel is transparent enabling observation of the display through the cover panel.

DETAILED DESCRIPTION OF THE PRESENTLY PREFERRED EMBODIMENTS

Figure 1:
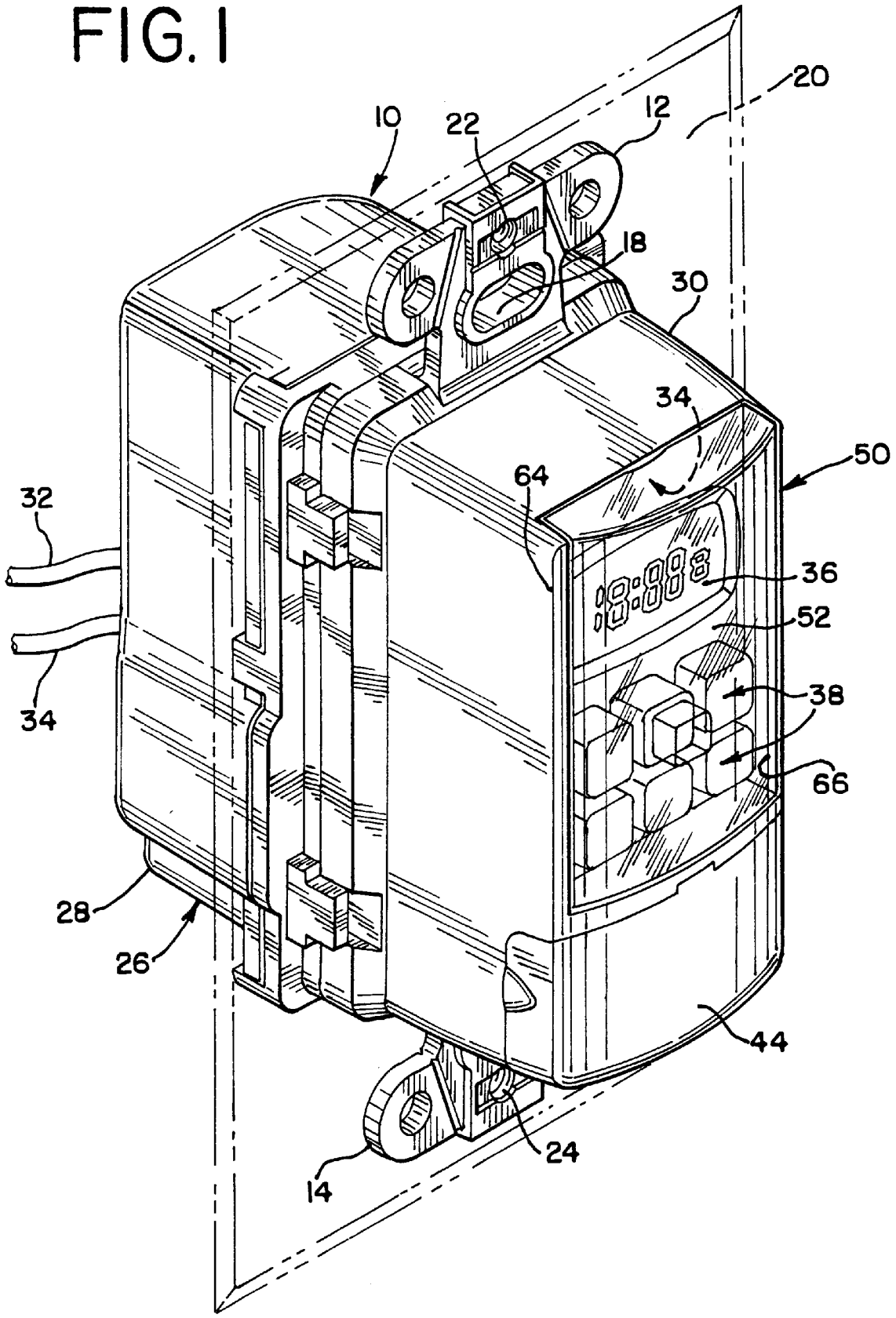
FIG. 1 is a perspective view of an in-wall electric timer according to a first embodiment of the present invention.
Figure 3:
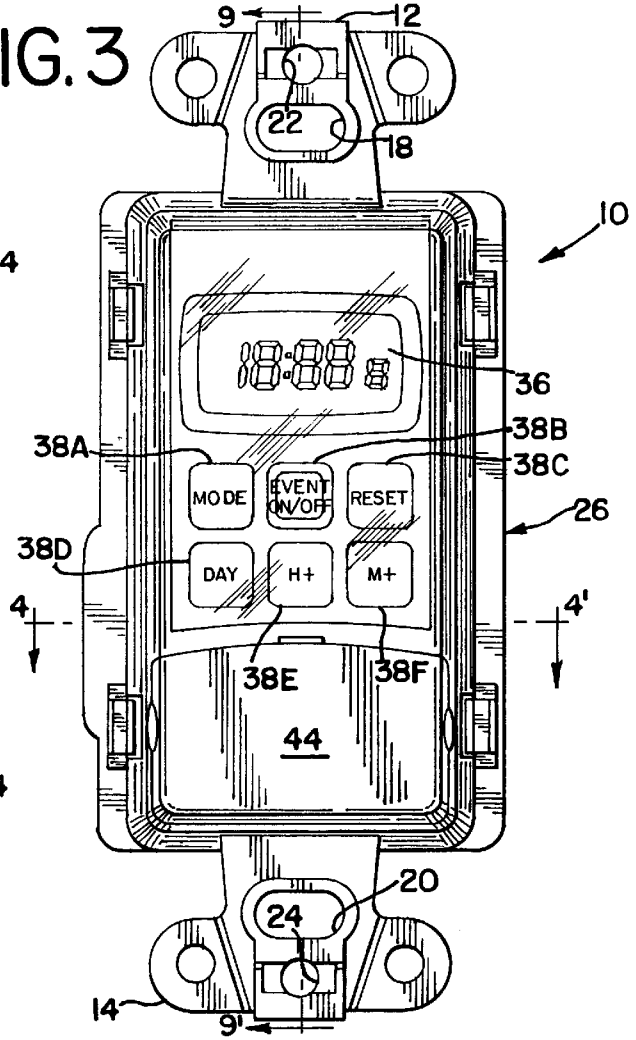
FIG. 3 is front view of the embodiment of FIG. 1.
Figure 2:
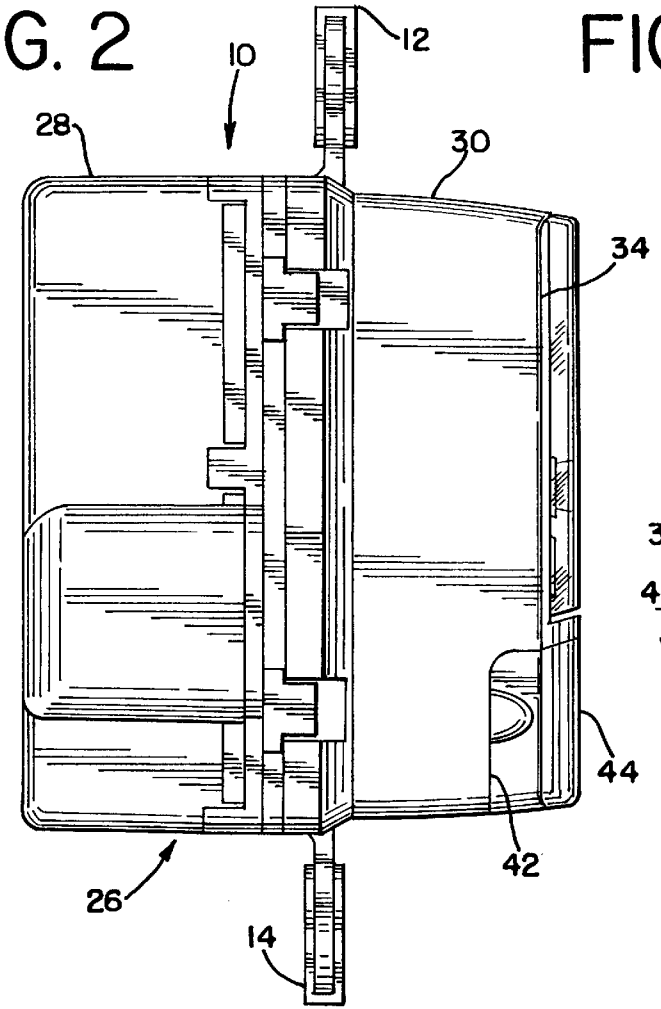
FIG. 2 is side view of the embodiment of FIG. 1.

Referring to FIGS. 1–3, an electric/electronic timer 10 is sized to be mounted in a conventional electric box. In particular, the electric timer 10 is sized so that it can replace a conventional wall switch. The electric timer 10 includes upper and lower flanges 12 and 14 having appropriately-spaced through holes 16 and 18 so that the electric timer 10 can be mounted in a conventional in-wall mounted electric box by means of standard-sized mounting screws (not shown). A cover plate 20 is mounted over the electric timer 10. In a preferred embodiment the cover plate is a standard Decora-type cover plate (shown in FIG. 1). The cover plate 20 is mounted onto the electric timer 10 in by means of screws (not shown) that extend through the cover plate and are received in threaded openings 22 and 24 in flanges 12 and 14, respectively. In alternative embodiments, other types of cover plates may be used. In further alternative embodiments, the cover plate may be incorporated into the timer and formed as a single piece therewith.

The electric timer 10 includes a housing 26. The housing 26 is comprised of two portions: an inner housing portion 28 and an outer housing portion 30. In general, the inner housing portion 28 is located inside of the cover plate 20 and the outer housing portion 30 is located outside of the cover plate 20 when the electric timer 10 is mounted in a conventional electric box. Electric wires 32 and 34 which would otherwise be connected to a conventional wall switch are connected instead to the electric timer 10 via wires or terminals (not shown) located on a back side of the inner housing portion 28. A controller (not shown) which is mounted inside the inner housing portion 28 operates a switch which is also located internally of the housing 26 to make and break an electric connection between the terminals.

Located on an upper front side 34 of the outer housing portion 30 is a input panel 38. The input panel 38 is comprised of a plurality of buttons. In the embodiment shown, the input panel 38 has six push buttons 38A—38F. The push buttons 38 are appropriately labeled to facilitate use of the push buttons for programming the functions of the electric timer. For example, the push buttons may be labeled "MODE", "EVENT ON/OFF", "RESET", "DAY", "H+" (i.e. "increment by 1 hour"), and "M+" (i.e. "increment by 1 minute"). This labeling is described by way of example and various other types of labeling may be provided and used. The input panel 38 is coupled to the controller internally of the housing 26 to allow a user to program the controller to control its functions to operate the timer 10, in a manner known in the art.

Also located on the upper front side 34 of the outer housing portion 30 is a display 36. The display 36 together with the input panel 38 comprise a user-interface of the electric timer 10. The display 36 may be a conventional type of display, such as an LED, LCD, active matrix, dual scan, and so on. The display 36 is coupled to the controller internally of the housing 26. The display 36 provides information to the user to facilitate programming the controller, in a manner known in the art. For example, the display 36 may display a current time-of-day, the current day of week, and the times programmed in the controller at which the electricity across the timer terminals will be switched on and off. The display 36 may be used in conjunction with the input panel 38 as a user interface to facilitate programming of the timer. For example, the display may show the times that the user is programming with the input panel 38.

Located on a lower front side 42 of the outer housing portion 30 is a lower panel 44. The lower panel 44 is a removable panel that provides access to an inside portion of the housing 26. The embodiment of the electric timer 10 shown in FIG. 1 has a battery backup feature, and therefore the lower panel 44 is used to provide access to an inside portion of the housing 26 in which a backup battery may be located.

Located on the upper front side 34 of the outer housing portion 30 and covering the display 36 and input panel 38 is a cover panel 50. The cover panel 50 includes as least a portion 52 through which the display 36 can be observed while the cover panel 50 is in place on the housing 26. In a preferred embodiment, the portion 52 is composed of a transparent window. In a further preferred embodiment, the entire cover panel 50 is composed of a single piece of transparent plastic, such a polycarbonate. (For purposes of this specification, the portion 52 of the cover panel 50 is considered to be "transparent" if it is possible to observe the display 36 through the portion 52 and therefore includes both transparent and translucent materials. In further alternative embodiments, the transparent portion 52 may be composed of an opening, openings, or a screen. In alternative embodiments, portions of the cover panel 50 other than the transparent portion 52 may be opaque.)

Figure 6:
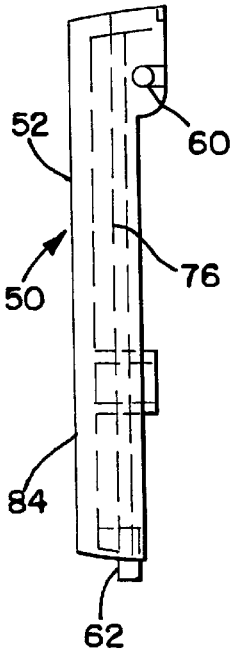
FIG. 6 is a side view of the cover panel shown in FIG. 5.
Figure 5:
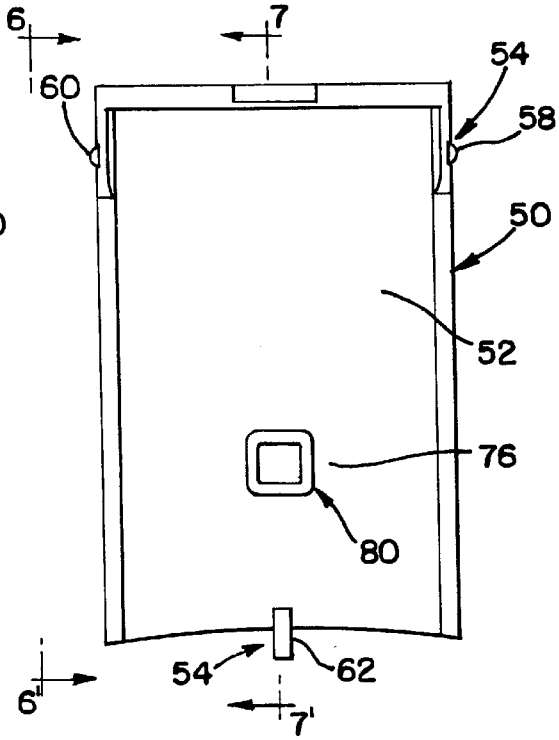
FIG. 5 is a rear view of the cover panel shown in the embodiment of FIG. 1.
Figure 4:
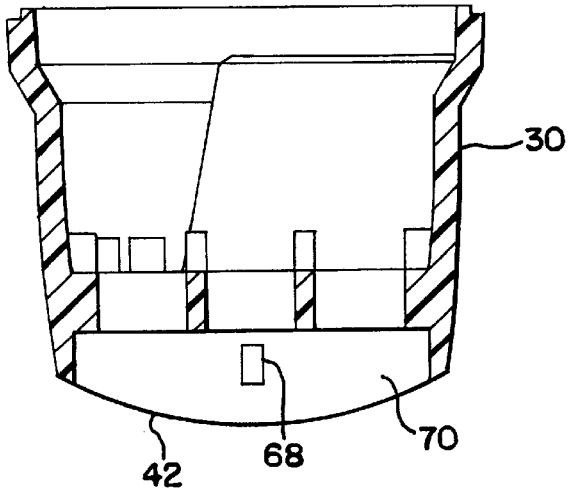
FIG. 4 is a cross sectional view of the front housing portion taking along line 4–4' of FIG. 3.
Figure 8:
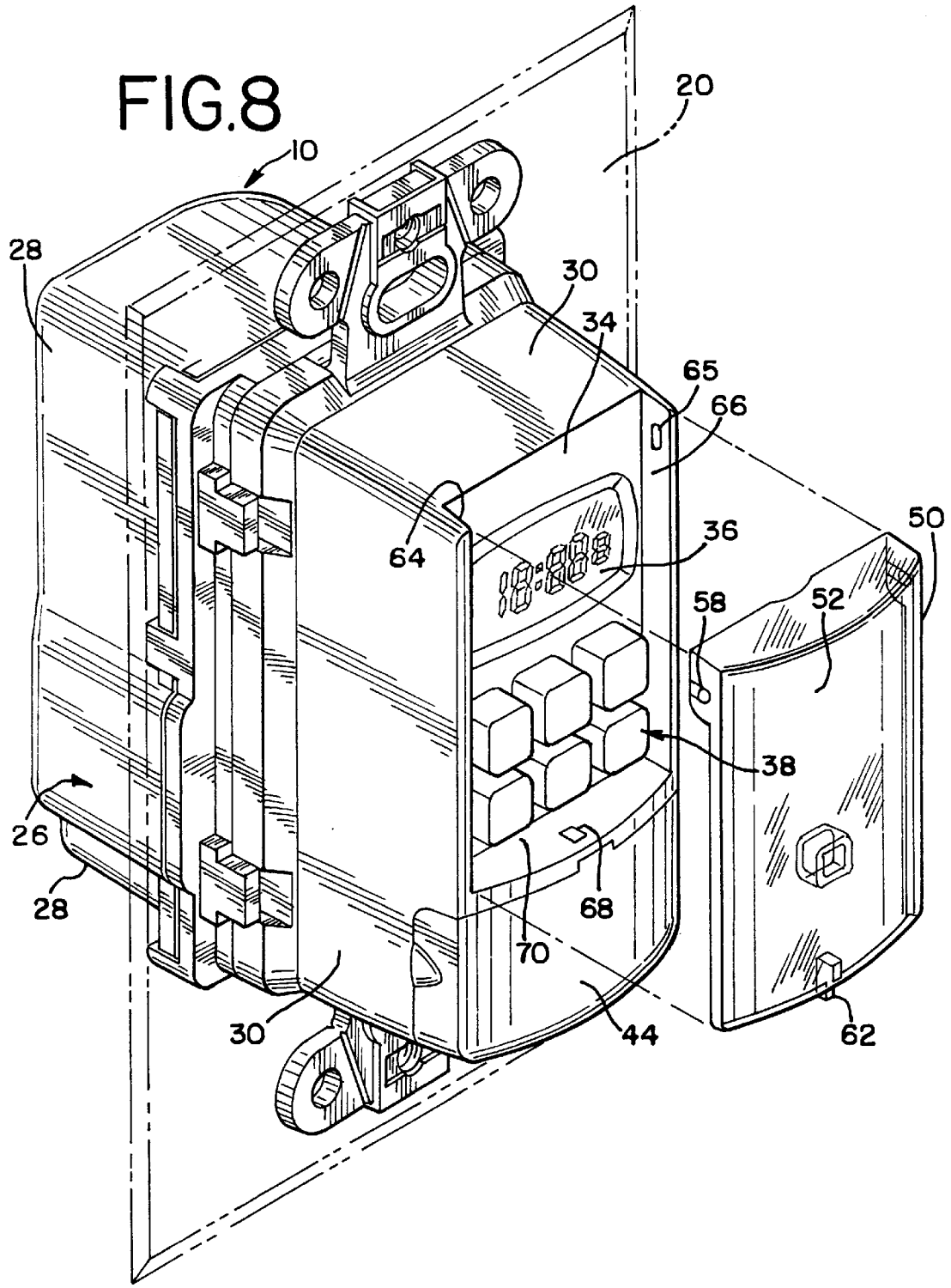
FIG. 8 is a perspective view similar to FIG. 1 showing the electric timer with the cover panel removed.

Referring to FIGS. 5–6, the cover panel 50 includes a fastening means 54 by which it can be connected to the front portion 34 of the housing 26. In a present embodiment, the fastening means 54 provides for the cover panel 50 to be connected to the housing 26 in a manner such that the cover panel 50 is movable while it is connected to the housing 26, as explained further below. In a present embodiment, the cover panel 54 includes a first pin 58, a second pin 60, and a third pin 62. The first and second pins 58 and 60 are located on and extend from the sides of the cover panel 50 close to an upper end thereof The third pin 62 is located on and extends from a bottom side of the cover panel 50. As shown in FIG. 8, the first and second pins 58 and 60 are received in corresponding recesses (only recess 65 shown) located in first and second vertical walls 64 and 66 extending forward from the upper front side 34 of the outer housing portion 30. As shown in FIGS. 4 and 8, a slot 68 is located in a third wall 70 that extends forward and horizontally from the front side 34 of the outer housing portion 30. The third pin 62 of the cover panel 50 is received in the slot 68.

Figure 7:
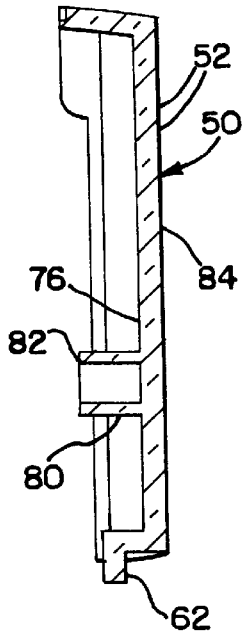
FIG. 7 is a sectional view taken along line 7–7' of the cover panel shown in FIG. 6.

Referring again to FIGS. 5–7, located on an inside surface 76 of the cover panel 50 is a rearward extending portion comprising an actuating post or stem 80. The actuating stem 80 has dimensions that correspond approximately to one of the push buttons 38. The actuating stem 80 is located on the inside surface 76 so that it aligns with one of the push buttons 38 when the cover panel 50 is connected onto the outer housing portion 30. In a preferred embodiment, the actuating stem 80 aligns with the push button 38B which is the "EVENT ON/OFF" push button. The actuating stem 80 extends from the inside surface 76 of the cover panel 50 by a length such that a tip 82 of the actuating stem 80 is close to and may come in contact with the push button 38B when the cover panel 50 is mounted on the front housing portion 30.

In a preferred embodiment, the cover panel 50 is removable. Referring to FIG. 8, the cover panel 50 is shown in a removed position relative to the front housing portion 30 of the timer 10. The cover panel 50 removed by gripping the panel by its front side 84 and lifting it vertically. To facilitate removing the cover panel 50, the recesses 65 in the walls 64 and 66 may be formed as shallow recesses so that the pins 58 and 60 are retained in the recesses by only slight friction so that the cover can easily be removed.

To operate the electric timer 10, the cover panel 50 is removed, as illustrated in FIG. 8. With the cover panel 50 removed, the push buttons 38 are accessible. Using the push buttons 38, a user may program the electric timer 10 to perform the desired functions in a manner known in the art. In conjunction with the push buttons 38, the display 36 is used to facilitate programming of the timer 10 by the user. The display 36 will graphically show the switching times (days, hours, minutes) that are being programmed by the user, in a manner known in the art. After the user has programmed the timer 10, the cover panel 50 is replaced by first inserting the third pin 62 into the slot 68 and snapping the first and second pins 58 and 60 into the recesses 65 in walls 64 and 66.

It is a significant advantage of the present embodiment that the electric timer 10 can be operated manually and used in a manner as a conventional wall switch. In many situations, it is desired to override the programming of the electric timer 10. For example, a user may want the electric timer 10 to automatically turn on lights in a room at 8:00

P.M. However, the user may enter the room and want to manually turn on the lights at 7:45 P.M. when it is already dark. Since it is dark, it may be difficult for the user to see the push buttons 38 which are relatively small and close together. With the present embodiment, because the cover panel 50 is located over the push buttons 38 and has the actuating stem 80 that aligns with the push button 38B that provides for manually operating the electric timer, the user may manually override the timer by pressing on the larger outside surface 84 of the cover panel 50.

Figure 9:
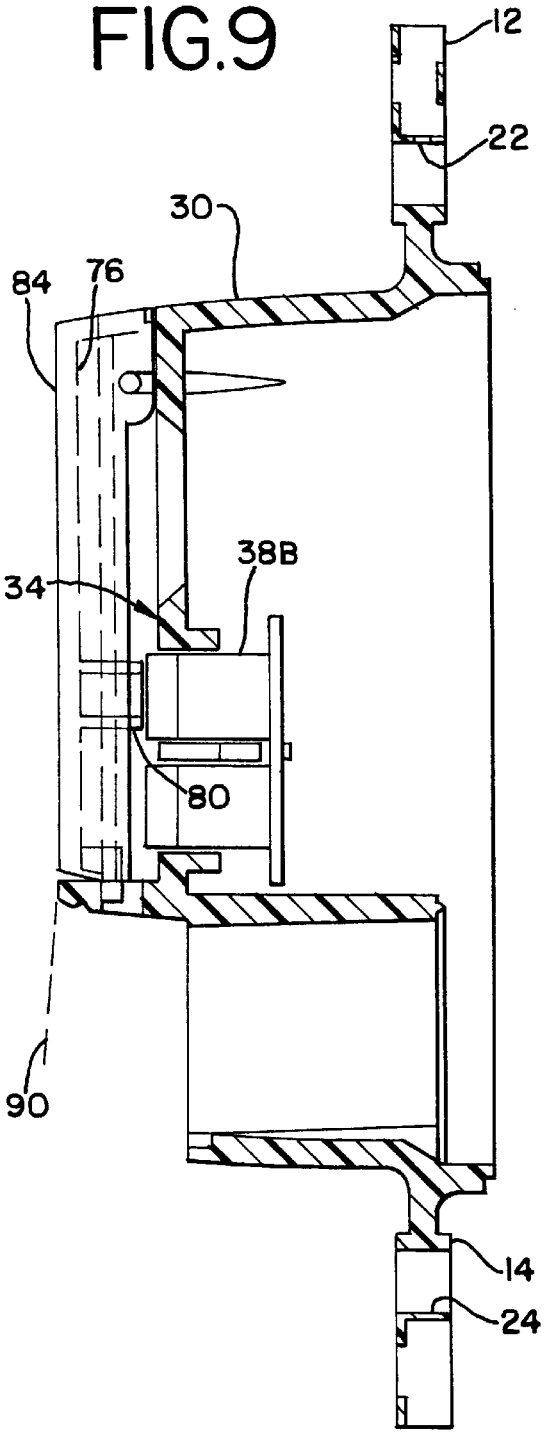
FIG. 9 is a sectional view of the outer housing portion and cover panel taken along line 9–9' of FIG. 3 showing the cover panel in a first position relative to the outer housing portion.

Referring to FIG. 9, the slot 68 in the third wall 70 of the front housing 30 has a size somewhat larger than the third pin 62. When the cover panel 50 is coupled to the outer housing portion 30 and the actuating stem 80 is aligned with the push button 38B, the tip 82 of the actuating pin 80 is close to and may come in contact with the push button 38B. When the cover panel 50 is in this first (or outer) position 90, the third pin 62 is located in a forward portion of the slot 68.

Figure 10:
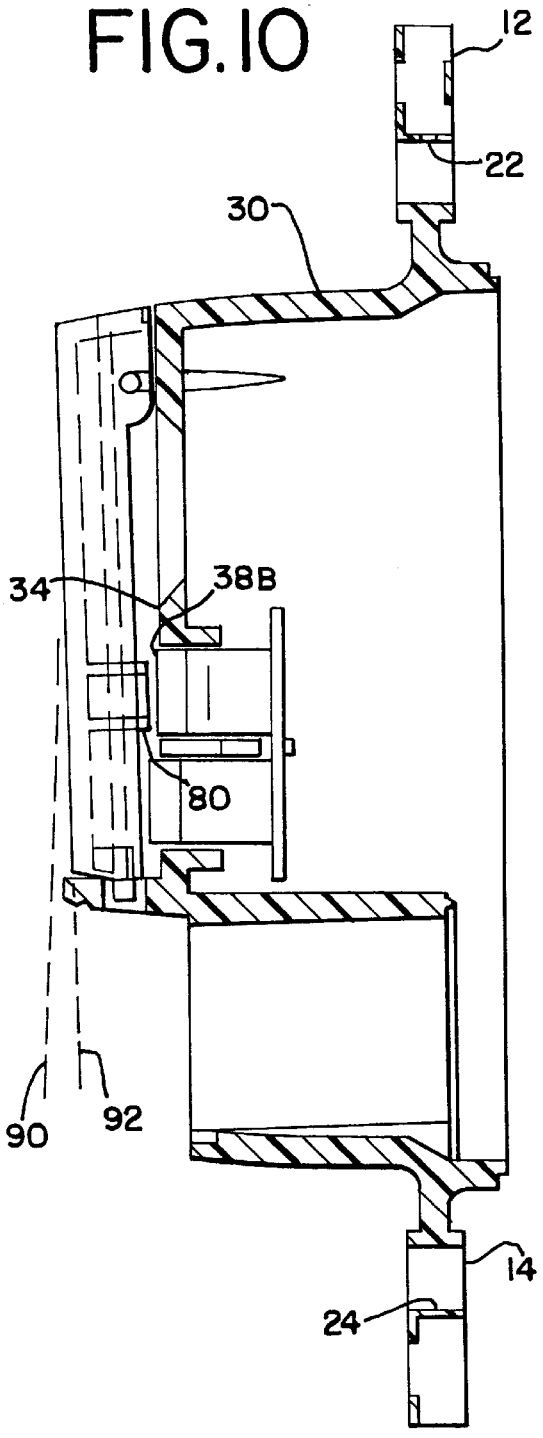
FIG. 10 is a sectional view similar to FIG. 9 showing the cover panel in a second position relative to the outer housing portion.

Referring to FIG. 10, when a force is applied to the front surface 84 of the cover panel 50, such as when the user presses it, the cover panel 50 pivots about the pins 58 and 60. The third pin 62 moves from the forward portion in the slot 68 to a rear potion of the slot 68. The cover panel 50 is moved from the first (or outer position 90 to a second (or inner) position 92. When moved into the inner position 92, the tip 82 of the actuating pin 80 bears against the push button 38B causing it to be activated and causing overriding of the timer functions to manually turn on the lights. Upon removing the force applied to the front surface 84 of the cover panel 50, the cover panel 50 is restored to the first position 90 by means of the resiliency of the push button 38B.

With the present embodiment, it is easy for a user to manually override the timer, even in the dark, since the outer surface 84 of the cover panel 50 is relatively large and relatively easy to find and operate. In addition, using the cover panel 50 to manually override the timer mimics the operation of a conventional electric switch so that it is easy to use even for persons unfamiliar with the electric timer. It is a further advantage of the electric timer 10 that display panel 36 is observable through the transparent window 52 at all times so that the user can confirm the operation and status of the electric timer 10 without removing the cover panel 50.

It is intended that the foregoing detailed description be regarded as illustrative rather than limiting and that it is understood that the following claims including all equivalents are intended to define the scope of the invention.

We claim:

1. An in-wall mounted electric timer comprising:

a housing for mounting in an electric box coupled to a wall;

a user interface including a plurality of activation elements on a front surface of said housing, said user-interface comprising an input panel and a display; and a movable cover panel covering said user interface and having a rearward extending post aligned with said input panel to operate said input panel by moving action of said cover panel, wherein at least a portion of said cover panel is transparent enabling observation of said display through said cover panel.

2. The invention of claim 1 wherein said electric timer conforms in format size to a standard size electric switch.

3. The invention of claim 1 wherein said electric timer conforms in format size to a standard size Decora style electric switch.

4. The invention of claim 1 wherein said input panel comprises a plurality of input controls including at least one push button operable to provide a manual override function of said electric timer, and wherein said rearward extending post is aligned with said at least one push button.

5. The invention of claim 1 wherein said cover panel is pivotable from a first position relative to said housing to a second position relative to said housing.

6. The invention of claim 1 wherein said cover panel is comprised of an entirely transparent material.

7. The invention of claim 1 wherein at least another portion of said cover panel is transparent enabling observation of said input panel therethrough.

8. The invention of claim 1 wherein at least another portion of said cover panel is opaque.

9. The invention of claim 1 wherein said cover panel is removable from said housing.

10. The invention of claim 1 wherein said housing further comprises:

an auxiliary panel located on said front said of housing, said auxiliary panel providing access to a backup battery inside said housing.

11. An in-wall mounted electric timer comprising:

a housing for mounting in an electric box in or on a wall, said housing having a front surface;

a display panel located on said front surface of said housing;

an input panel located on said front surface of said housing and including at least one push button;

a cover panel covering said display panel and said input panel, said cover panel having at least one transparent portion to permit observation of said display panel through said cover panel; and a post located on an inside part of said cover panel and aligned with said at least one push button, wherein said post is operable to bear against and actuate said at least one push button when a force is applied to an outside surface of said cover panel.

12. The invention of claim 11 wherein said electric timer conforms in format size to a standard size electric switch.

13. The invention of claim 11 wherein said electric timer conforms in format size to a standard size Decora style electric switch.

14. The invention of claim 11 wherein said cover panel is pivotable from a first position relative to said housing to a second position relative to said housing.

15. The invention of claim 11 wherein said cover panel is entirely transparent.

16. The invention of claim 11 wherein said cover panel is removable from said housing.

17. The invention of claim 11 wherein said housing further comprises:

an auxiliary panel located on said front said of housing, said auxiliary panel providing access to a backup battery location inside said housing.

18. The invention of claim 11 wherein at least another portion of said cover panel is transparent enabling observation of said input panel therethrough.

19. An electric timer comprising:

a housing;

a plurality of push buttons located on said housing;

a display located on said housing;

a cover panel covering said display and said push buttons, said cover panel having a transparent window exposing said display and having an inside part aligned with one of said push buttons; and wherein said cover panel is coupled to said housing by means of a connection that enables movement of said cover panel relative to said housing upon application of a force upon an outside surface of said cover panel.

20. The invention of claim 19 wherein said entire cover panel is comprised of a transparent material.

21. The invention of claim 19 wherein said housing conforms in format size to a standard size electric switch.

22. An in-wall mounted electric timer comprising:

a housing for mounting in an electric box coupled to a wall;

a user interface on a front surface of said housing, said user-interface comprising a plurality of activation elements; and a moveable cover panel covering said user interface and having a rearward extending post aligned with at one of said activation elements to operate at least one of said activation elements by moving action of said cover panel, and wherein said cover may be moved away from said at least one of said activation elements in order to provide access to said at least one of said activation elements.

23. The in-wall mounted electric timer of claim 22 wherein the cover is pivotable.

24. The in-wall mounted electric timer of claim 23 wherein the cover can be pivoted upward and away from the push buttons.

* * * * *

UNITED STATES PATENT AND TRADEMARK OFFICE

CERTIFICATE OF CORRECTION

PATENT NO. : 6,121,889
DATED : September 19, 2000
INVENTOR(S) : Rudolph W. Janda et al.

It is certified that error appears in the above-identified patent and that said Letters Patent is hereby corrected as shown below:

Claim 1,
Lines 4-5, delete "including a plurality of activation elements".
Line 6, after "panel" insert -- including a plurality of activation elements --.
Line 8, after "aligned with" insert -- one of said activation elements of --.

Signed and Sealed this

Ninth Day of April, 2002

*Attest:*

*Attesting Officer*

JAMES E. ROGAN
*Director of the United States Patent and Trademark Office*